US009303634B2

(12) United States Patent
Furet et al.

(10) Patent No.: US 9,303,634 B2
(45) Date of Patent: Apr. 5, 2016

(54) PROPORTIONAL DOSIMETER FOR METERING AN AUXILIARY LIQUID INTO A MAIN LIQUID

(75) Inventors: Sebastien Furet, Tresses (FR); Philippe Duquennoy, Tresses (FR); Christophe Charriere, Tresses (FR)

(73) Assignee: DOSATRON INTERNATIONAL, Tresses (FR)

( * ) Notice: Subject to any disclaimer, the term of this patent is extended or adjusted under 35 U.S.C. 154(b) by 526 days.

(21) Appl. No.: 13/883,602

(22) PCT Filed: Nov. 7, 2011

(86) PCT No.: PCT/IB2011/054948

§ 371 (c)(1),
(2), (4) Date: May 31, 2013

(87) PCT Pub. No.: WO2012/063184

PCT Pub. Date: May 18, 2012

(65) Prior Publication Data

US 2013/0233421 A1 Sep. 12, 2013

(30) Foreign Application Priority Data

Nov. 8, 2010 (FR) ..... 10 59182

(51) Int. Cl.
*F04B 13/02* (2006.01)
*F04B 13/00* (2006.01)
(Continued)

(52) U.S. Cl.
CPC ..... *F04B 13/00* (2013.01); *F04B 9/105* (2013.01); *F04B 9/1053* (2013.01); *F04B 13/02* (2013.01); *F04B 43/067* (2013.01); *F04B 43/107* (2013.01); *Y10T 137/85986* (2015.04)

(58) Field of Classification Search
CPC ..... F04B 13/02
USPC ..... 60/421; 222/145.5; 417/403
See application file for complete search history.

(56) References Cited

U.S. PATENT DOCUMENTS 2,871,789 A 2/1959 Kiffer et al.
4,756,329 A * 7/1988 Cloup ..... F04B 13/02 91/224

(Continued)

FOREIGN PATENT DOCUMENTS

DE 12 21 028 7/1966
EP 0 255 791 12/1989

(Continued)

OTHER PUBLICATIONS

International Search Report dated Jan. 30, 2012, corresponding to PCT/IB2011/054948.

*Primary Examiner* — Thomas E Lazo
(74) *Attorney, Agent, or Firm* — Young & Thompson

(57) ABSTRACT

Proportional dosimeter including a metering body with a main liquid inlet (2) and an outlet (3), a hydraulic motor (4) housed in the body, actuated by the main liquid, and connected to a plunger piston (5) that moves in a first chamber (6), the piston plunger drawing in fluid in an outbound stroke, a check valve provided to allow liquid to pass to the interior volume of the body when the pressure in the first chamber exceeds a certain pressure, during the return stroke; the dosimeter includes a second chamber (12) of variable volume bounded by a membrane subjected to the pressure in the first chamber, the second chamber including an intake orifice (20) for the auxiliary liquid and a delivery orifice (23) for the auxiliary liquid, this delivery orifice being connected by a pipe (26) to an injection chamber (S) situated downstream of the outlet of the dosimeter body.

16 Claims, 4 Drawing Sheets

(51) Int. Cl.

| | |
|---|---|
| ***F04B 9/105*** | (2006.01) |
| ***F04B 43/067*** | (2006.01) |
| ***F04B 43/107*** | (2006.01) |

(56) References Cited

U.S. PATENT DOCUMENTS

| | | | | | |
|---|---|---|---|---|---|
| 5,055,008 | A * | 10/1991 | Daniels | F04B 13/02 | 91/229 |
| 5,234,322 | A * | 8/1993 | Daniels | G05D 11/133 | 417/403 |
| 5,951,265 | A * | 9/1999 | Bryant | F04B 9/105 | 60/406 |
| 6,129,526 | A * | 10/2000 | Kelly | F04B 53/107 | 417/403 |
| 7,975,597 | B2 | 7/2011 | Darbois et al. | | |
| 2007/0227961 | A1 * | 10/2007 | Barras | B01F 5/0413 | 210/258 |

FOREIGN PATENT DOCUMENTS

| | | |
|---|---|---|
| EP | 0 885 357 | 8/2002 |
| EP | 1 971 774 | 5/2009 |
| FR | 2 329 980 | 5/1977 |
| WO | 88/09006 | 11/1988 |

* cited by examiner

PROPORTIONAL DOSIMETER FOR METERING AN AUXILIARY LIQUID INTO A MAIN LIQUID

The invention relates to a proportional dosimeter for metering an auxiliary liquid into a main liquid, the dosimeter being of the kind comprising a dosimeter body with a main liquid inlet and an outlet, a hydraulic motor housed in the body, actuated by the main liquid, and connected to a plunger piston to drive same in a reciprocating rectilinear movement, the plunger piston moving in a first chamber that is open at a first end away from the hydraulic motor and opens at a second end into the interior volume of the dosimeter body containing main liquid, the plunger piston performing an intake phase during an outward stroke in which it moves away from the first end of the chamber, it being possible for the plunger piston to leave the first chamber at the end of the outward stroke, a valve being provided to allow the liquid to pass to the interior volume of the body, during the return stroke, once a certain pressure in the first chamber is exceeded.

A proportional dosimeter of this type is known notably from patent EP 0 255 791 B1. A proportional dosimeter such as this operates without electricity, actuated only by the main liquid and allows product, which constitutes the auxiliary liquid, to be injected into the main liquid which is generally water at a relatively low inlet pressure.

A great many known proportional dosimeters mix the main liquid and the auxiliary liquid in the body of the dosimeter in such a way that the outlet orifice of the dosimeter body supplies the mixture. In some cases, notably when the auxiliary liquid is harmful to elements situated inside the dosimeter body, or in applications in which reaction between the metered product and the motive product leads to calcification which could cause premature wear to the dosimeter, it is desirable to avoid any introduction of auxiliary liquid into the dosimeter body and to perform the mixing downstream of the dosimeter body.

Patent EP 0 885 357 B1, in the name of the Applicant Company, proposes a solution to this problem, involving an expanding bellows. This solution is effective, but requires significant modification to the metering pump.

It is a special object of the invention to provide a proportional dosimeter which avoids auxiliary liquid entering the body of the dosimeter and performs the mixing of the two liquids at outlet downstream of the dosimeter, using simple modifications to a conventional dosimeter allowing ease of adaptation with the benefit of modularity. It is further desirable for the proportional dosimeter, while performing the mixing at outlet downstream, to allow adjustment of the metered quantity.

According to the invention, a proportional dosimeter of the kind defined hereinabove is characterized in that it comprises a variable-volume second chamber bounded by a membrane subjected to the pressure obtaining in the first chamber, the second chamber comprising an intake orifice for the auxiliary liquid and a delivery orifice for the auxiliary liquid, this delivery orifice being connected by a duct to an injection chamber situated downstream of the outlet of the dosimeter body so that the auxiliary liquid can mix with the emerging main liquid.

The dosimeter is advantageously arranged in such a way that the pressure in the interior volume of the dosimeter body is greater than the sum of the pressure in the injection chamber and of the loss of hydraulic head in the connection between the second chamber and the injection chamber.

For preference, a restriction member is provided downstream of the outlet of the dosimeter and upstream of the injection chamber in order to create a head loss, particularly a loss of head that is enough to push the membrane back at the end of the intake phase, notably when the plunger piston leaves the first chamber at the end of the outward stroke.

In the case of a pump configuration in which the interior volume of the dosimeter body communicates directly with the outlet, the pressure would be substantially the same in the interior volume of the body and at the outlet; the head loss created by the restriction member makes it possible to ensure that there is enough of a pressure difference between the interior volume of the dosimeter body and the injection chamber.

In the case of a pump configuration in which the interior volume of the dosimeter body communicates directly with the inlet of the dosimeter, the head loss of the motor between the interior volume of the dosimeter body and the outlet, if greater than the loss of hydraulic head in the connection between the second chamber and the injection chamber, may be enough to push the membrane back.

The second chamber is equipped with an intake valve and with a delivery valve; these valves and the restriction member are adjusted in such a way to ensure correct dosimeter operation.

Advantageously, the membrane, on the opposite side to the second chamber, bounds a space communicating with the first end of the first chamber.

For preference, the second chamber is situated in a volume bounded by opposing concavities of a first cup and of a second cup which are assembled, the periphery of the membrane being clamped in a fluid tight manner between the two assembled cups, the first cup being fixed to the dosimeter body around the first end of the first chamber, while the second cup is equipped with the intake orifice and with the delivery orifice. The second chamber is thus formed between the membrane and the concavity of the second cup, it being possible for the membrane to press against the concavity of the first cup or that of the second cup.

Advantageously, the central part of the membrane is secured to a rigid disk itself secured to an axial rod facing away from the second chamber and able to slide in a guide bore of the dosimeter body, while leaving a passage for the liquid. Such guidance is merely optional.

For preference, the axial position of a sleeve delimiting the cylindrical first chamber in which the plunger piston moves can be adjusted using a rotary ring.

The restriction member situated downstream of the outlet of the dosimeter body may consist of a plug fitted with a cylindrical skirt with at least one, notably longitudinal slot, installed on an inlet orifice of a union connected to the outlet of the dosimeter body, and the axial position of which is adjustable.

The valve provided to allow the liquid to pass to the interior volume of the body during the return stroke, once the pressure in the first chamber has exceeded a certain pressure may be a preloaded valve installed in a chamber provided at the end of the plunger.

According to an alternative, the interior volume of the dosimeter body communicates directly with the inlet of the dosimeter so that the head loss of the motor between the interior volume of the dosimeter body and the outlet contributes to pushing the membrane back. The head loss of the motor between the interior volume of the dosimeter body and the outlet, if higher than the loss of hydraulic head in the connection between the second chamber and the injection chamber, may be enough to push the membrane back, in which case the restriction member could be omitted.

Apart from the provisions set out hereinabove, the invention consists in a certain number of other provisions that will be considered more explicitly herein below in connection with some exemplary embodiments described with reference to the appended drawings, but which are not in any way limiting. In these drawings.

Figure 1:
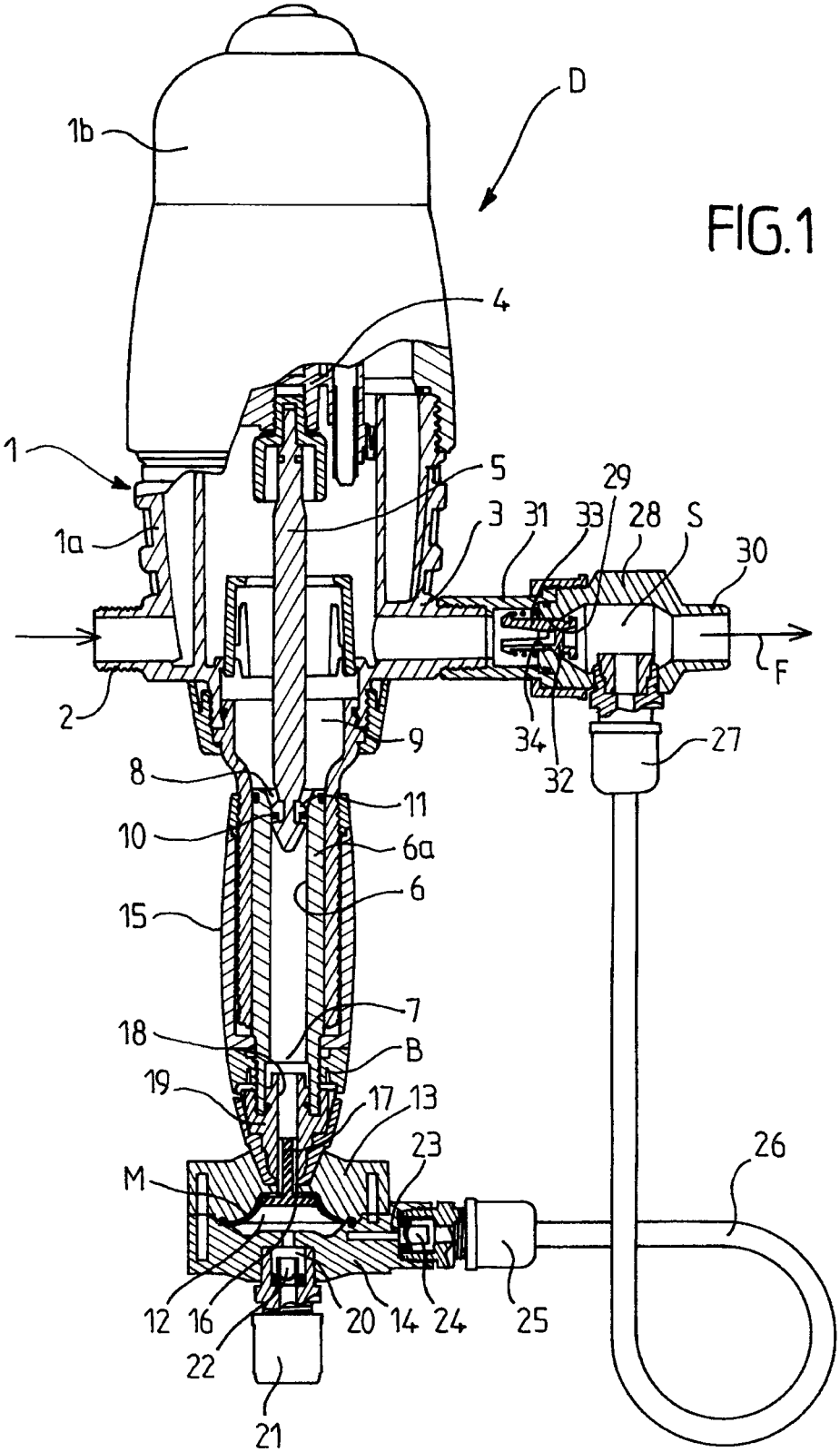
FIG. 1 is an axial vertical section, with some parts shown in external view, of a proportional dosimeter according to the invention, in the upstroke phase of admitting auxiliary liquid.

Reference is made to the drawings and notably to FIG. 1 depicting a proportional dosimeter D for metering an auxiliary liquid into a main liquid, which comprises a dosimeter body 1, generally made up of two parts, namely a base 1*a* and a cap 1*b* screwed onto this base, comprising an inlet 2 for main liquid and an outlet 3. A hydraulic motor 4, just a lower part of which is visible in the drawing, is housed in the body 1. The geometric axis of this body 1 is positioned generally vertically and the motor 4 is situated essentially inside the cap 1*b*. The motor 4 is actuated by the main liquid and generally comprises a differential piston with hydraulic means of switching at the ends of the outward and return strokes in order to reverse the direction of movement. Motors of this type are marketed by the Applicant Company. An example of such motors is described in patent EP 1 971 774 B1 in the name of the Applicant Company.

The hydraulic motor 4 is connected to a plunger piston 5, which in the layout of FIG. 1 is vertical, to drive same in a reciprocating rectilinear movement. The plunger piston 5 moves inside a cylindrical first chamber 6, delimited by a sleeve 6*a*, open at a first end 7 distant from the hydraulic motor 4. The chamber 6 opens at a second end 8 into the interior volume 9 of the dosimeter body containing main liquid.

The plunger piston 5 is equipped, toward its lower end, with a sealing ring 10 acting as a valve, surrounding the plunger piston and housed in a groove 11. This groove 11 allows the sealing ring 10 a degree of excursion during the delivery stroke (the downstroke) of the piston 5 in order to allow liquid to pass from the chamber 6 into the space 9 once a certain pressure is exceeded.

The plunger piston 5, when effecting an outward stroke that moves it away from the first end 7 of the chamber, creates an intake phase and, when effecting a return stroke toward said first end 7, the piston 5 causes an increase in pressure in the chamber 6.

According to the invention, the dosimeter D comprises a variable-volume second chamber 12, bounded by a membrane M subjected to the liquid pressure obtaining in the first chamber 6. The membrane M is flexible and deformable. The second chamber 12 is advantageously situated in a volume bounded by the opposing concavities of two hollow cups 13, 14 which are assembled such that they can be dismantled. The cup 13, which in the depiction of FIG. 1 is the upper cup, is fixed to the lower end of a post 15 of the dosimeter body in which the sleeve 6*a* and the chamber 6 are to be found. The membrane M in its central part is fixed to a rigid disk 16 secured to an axial rod 17, orthogonal to the disk, facing toward the chamber 6. The rod 17 is fitted, with enough radial clearance to allow liquid to pass, into a bore 18 of an end fitting 19 provided at the lower part of the post 15. The rod 17 is long enough to guide the disk 16 and the membrane during the movements of the latter. The peripheral edge of the membrane is clamped in a fluid tight manner between the two cups 13, 14 and may have a thicker lip encouraging a good seal.

The second chamber 12 is equipped with an intake orifice 20, provided in the cup 14, which in the depiction of FIG. 1 is the lower cup. The auxiliary liquid may come from a reservoir (not depicted) connected by a pipe to a coupling 21 with which the orifice 20 is fitted. An intake valve 22 is also provided, at this orifice 20, to allow auxiliary liquid to be admitted to the chamber 12 and prevent it from being delivered therefrom.

The cup 14 further comprises a delivery orifice 23, communicating with the chamber 12, equipped with a delivery valve 24 and with a coupling 25 to which a flexible pipe 26 is connected. The delivery coupling 24 opens when the pressure in the chamber 12 increases so as to allow the liquid to pass to the pipe 26. This delivery valve 24 closes when auxiliary liquid is being admitted.

The flexible pipe 26 is connected, by a coupling 27, to a union 28 delimiting an injection chamber S downstream of the outlet 3. The T-shaped union 28 has a lateral orifice on which the coupling 27 is fitted, an axial orifice 29 on the same side as the outlet 3, and another axial orifice 30 on the opposite side. The orifice 29 is fitted with a coupling 31 at the outlet 3 from the dosimeter.

The union 28 and the coupling 27 and the auxiliary-liquid inlet are all situated downstream of the outlet 3 of the dosimeter, and the auxiliary liquid does not enter the interior volume 9 of the dosimeter. The mixing of the auxiliary liquid with the main liquid takes place downstream of the outlet 3, and the mixture is discharged through the orifice 30, as indicated by the arrow F.

On the opposite side to the second chamber 12, the membrane M delimits a space E (see FIG. 2) communicating with the first chamber 6 via the bore 18. This space E is also bounded by the bottom of the concavity of the cup 13.

A restriction member 32 is provided on the outlet side of the dosimeter body, upstream of the coupling 27 and of the injection of auxiliary liquid. This restriction member 32 is designed to create enough of a head loss between the downstream end and the interior volume 9 situated upstream. The pressure difference thus created between the volume 9 and the injection chamber S is set to a value higher than the loss of hydraulic head of the delivery line comprising the pipe 26 and the valves 25, 27 (head loss in the coupling between the second chamber and the injection chamber) so that the membrane M can be pushed back at the end of the intake phase. This difference in pressure between the volume 9 and the chamber S is advantageously at least 0.2 bar. The restriction member 32 generally consists of a preloaded nonreturn valve which prevents product from returning to the dosimeter body.

The restriction member 32 may consist of a plug with a cylindrical skirt 33 having at least one slot 34, notably a longitudinal slot, giving it a certain degree of elasticity. The longitudinal position of the member 32 in the orifice 29 can be adjusted so as to be able to alter the head loss. The member 32, at each of its ends, has shoulders which keep it in the orifice 29. A spring may be provided for returning the member 32 toward the desired restriction position.

The dosimeter works as follows.

The intake phase corresponds to the upstroke according to FIG. 1, or outward stroke, of the hydraulic motor 4 and of the plunger piston 5, which stroke creates a depression in the first chamber 6. This depression causes the membrane M to move upward, which corresponds to an increase in the volume of the chamber 12. The membrane M itself creates a depression in the chamber 12, and this causes the intake valve 22 to lift and auxiliary liquid to enter the chamber 12, while the delivery valve 24 remains closed.

When the plunger piston 5 leaves the chamber 6 at the end of its outward stroke, the pressure difference there is between the interior volume 9 of the dosimeter body and the injection chamber S allows the membrane M to be pushed back bringing about a start of delivery through the opening of the valve 24 and the injection into the pipe 26 and the chamber S.

For preference, the longitudinal position of the chamber 6 can be adjusted, notably using a ring B which, when turned, is able to adjust the axial position of the sleeve 6*a* the wall of which can slide inside the body. Means such as those disclosed in FR 2 681 646 can be provided to allow such adjustment.

The intake valve 22, the delivery valve 24, the sealing ring 10 of the plunger piston and the restriction member 32 are sized and adjusted to ensure correct operation of the dosimeter.

Figures 2, 3:
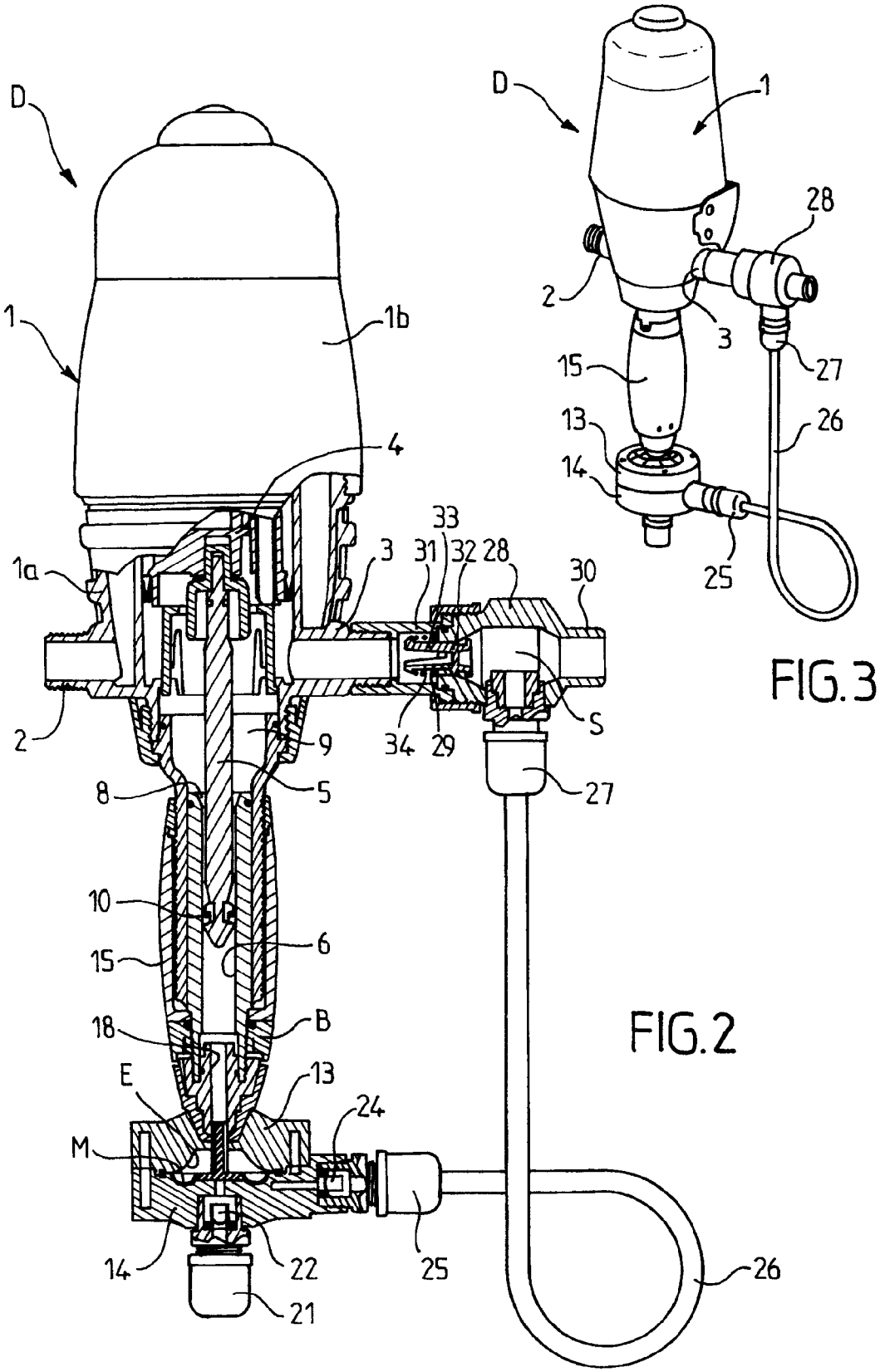
FIG. 2 shows, in a similar way to FIG. 1, the dosimeter in the downstroke phase of injecting the auxiliary liquid.
FIG. 3 is a perspective external view, on a smaller scale, of the dosimeter according to the invention.

During the delivery phase, which corresponds to FIG. 2, the piston 5 moves down inside the chamber 6, thereby creating a slightly raised pressure in the body of the dosimeter B as a result of the head loss across the sealing ring 10 which acts as a valve. The downward movement of the piston 5 is not enough to cause delivery into the injection chamber S. Delivery is performed through the fact that the pressure in the interior volume 9 is greater than the loss of hydraulic head in the connecting line 25, 26, 27. The membrane M is thus made to move fully and the valve 24 kept open.

The membrane M is driven downward, the intake valve 22 is closed, while the delivery valve 24 is opened to inject auxiliary liquid into the chamber S. The membrane M presses against the wall of the concavity face of the cup 14.

The mobile sealing ring 10 of the plunger 5 acts like a safety valve to prevent an excessive increase in pressure in the chambers 6 and 12.

Figures 4, 5:
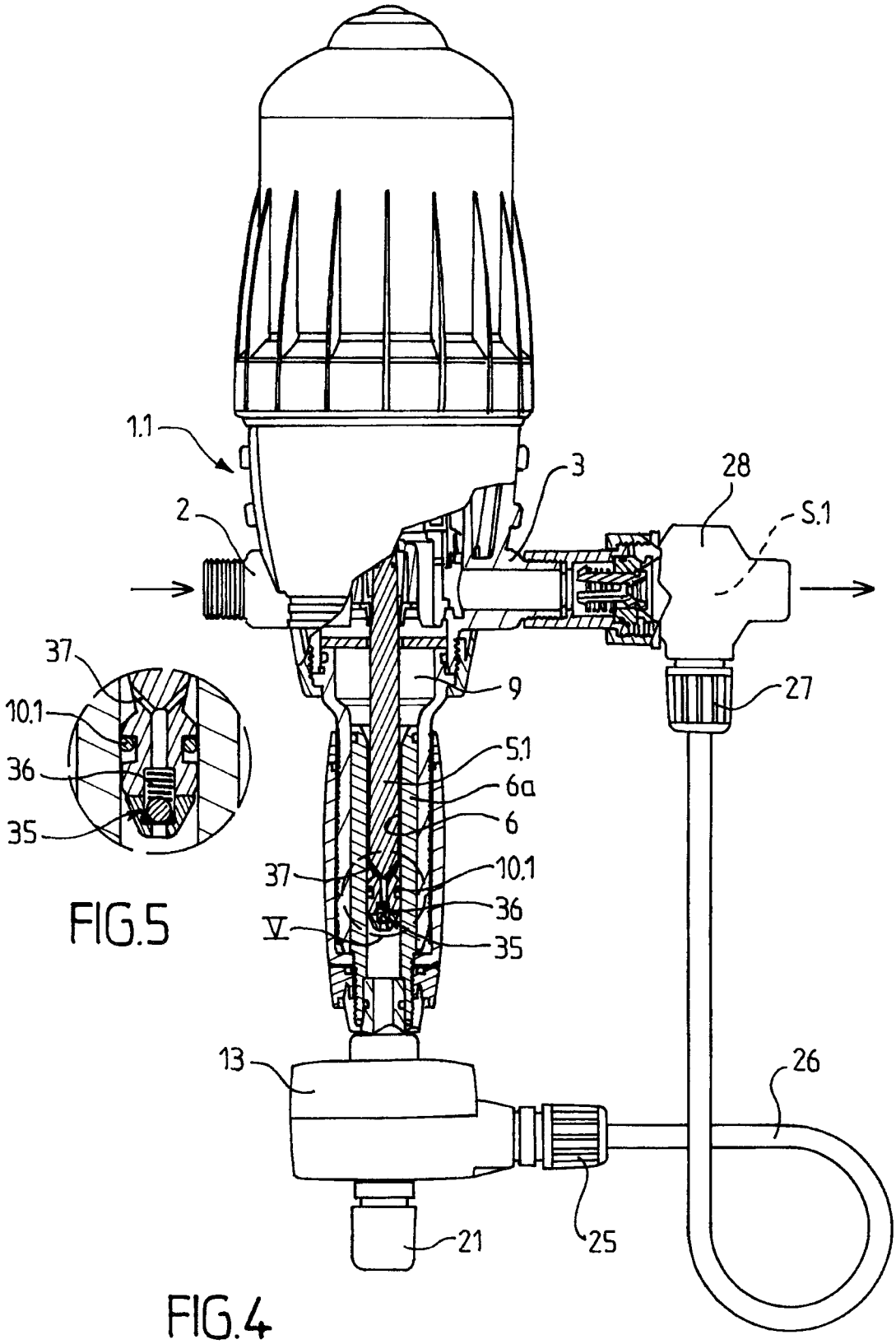
FIG. 4 is an axial vertical section, with some parts shown in external view, of an alternative form of dosimeter according to the invention, in the downstroke phase.
FIG. 5 is an enlarged detail of region V of FIG. 4.

FIGS. 4 and 5 illustrate an alternative form of embodiment with a dosimeter body 1.1 in which the plunger 5.1 is fitted with a fixed sealing ring 10.1, which is sealed during the upstroke and the downstroke, and with a preloaded safety valve 35. Elements identical or similar to elements already described in connection with the preceding figures are denoted by the same references, and are not described again.

The valve 35, advantageously of the ball and spring type, is installed in a chamber 36 provided at the end of the plunger 5.1 and open at its end. The chamber 36 communicates via ducts 37 with the space situated beyond the sealing ring 10.1, on the same side as the volume 9 of the dosimeter body. The valve 35 can open during the downstroke of the plunger 5.1 when the pressure in the lower part of the chamber 6 exceeds a limit set by the preload of the valve. During the upstroke of the plunger 5.1, the valve 35 remains closed.

The way in which the alternative form of FIGS. 4 and 5 works is similar to that of the dosimeter of FIGS. 1-3. However, the valve function 35 makes it possible to set the opening pressure so that the membrane is pushed back.

The benefit of the alternative form of FIGS. 4 and 5 is that a set opening pressure can be applied by use of the preloaded valve 35. A conventional embodiment using a floating sealing ring on the other hand is accompanied by a singular low loss of hydraulic head when the flow rate is low.

FIGS. 1-3 correspond to a pump configuration whereby the interior volume 9 of the dosimeter body communicates directly with the outlet 3; the pressure is substantially the same in the interior volume of the body and at the outlet; the head loss created by the restriction member 32 makes it possible to ensure there is enough of a pressure difference between the interior volume 9 of the dosimeter body and the injection chamber S.

Figure 6:
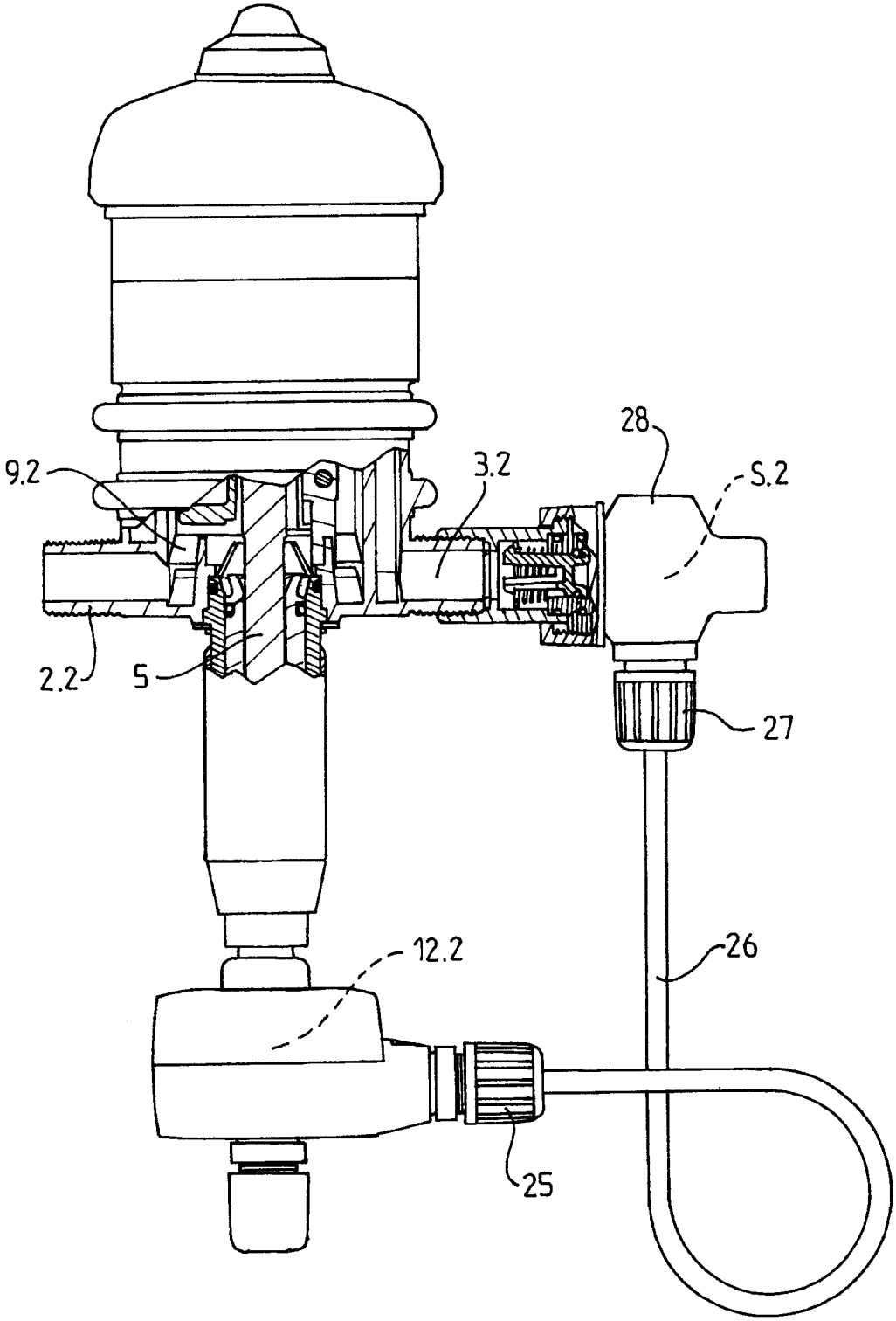
FIG. 6 is an axial vertical section, with some parts shown in external view, of another alternative form of dosimeter whereby the water inlet communicates directly with the dosimeter body.

FIG. 6 illustrates a pump configuration whereby the interior volume 9.2 of the dosimeter body communicates directly with the inlet 2.2 of the dosimeter. The head loss of the motor between the interior volume 9.2 of the dosimeter body and the outlet 3.2, if greater than the loss of hydraulic head in the connection between the second chamber 12.2 and the injection chamber S.2, may be enough to push the membrane back, in which case the restriction member 32 could be omitted.

The proportional dosimeter according to the invention makes it possible, in an effective and economic way, to avoid any ingress of auxiliary liquid into the body of the dosimeter while at the same time using a dosimeter body and a hydraulic motor both of which are conventional, by replacing the standard intake valve with a kit that is simple to fit.

The membrane M is controlled using the main liquid, generally the motive water, and a metering plunger piston 5. The construction of the whole is thereby facilitated. Direct control using the plunger piston 5 means that there is no need for the kind of pressure-equalizing system that would be required on an electric pump controlled hydraulically with an intermediate fluid. If the line 26 downstream of the delivery valve 24 becomes plugged, the sealing ring 10 of the plunger piston 5 exercises its safety-valve function.

The invention claimed is:

1. A proportional dosimeter for metering an auxiliary liquid into a main liquid, comprising a dosimeter body with a main liquid inlet (2, 2.2) and an outlet (3, 3.2), a hydraulic motor (4) housed in the body, actuated by the main liquid, and connected to a plunger piston (5, 5.1) to drive same in a reciprocating rectilinear movement, the plunger piston moving in a first chamber (6) that is open at a first end (7) away from the hydraulic motor and opens at a second end (8) into the interior volume (9, 9.2) of the dosimeter body containing main liquid, the plunger piston performing an intake phase during an outward stroke in which it moves away from the first end (7) of the chamber, it being possible for the plunger piston to leave the first chamber at the end of the outward stroke, a valve being provided to allow the liquid to pass to the interior volume of the body, during the return stroke, once a certain pressure in the first chamber is exceeded, characterized in that it comprises a variable-volume second chamber (12) bounded by a membrane (M) subjected to the pressure obtaining in the first chamber (6), the second chamber (12) comprising an intake orifice (20) for the auxiliary liquid and a delivery orifice (23) for the auxiliary liquid, this delivery orifice being connected by a duct (26) to an injection chamber (S) situated downstream of the outlet of the dosimeter body so that the auxiliary liquid can mix with the emerging main liquid.

2. The dosimeter as claimed in claim 1, characterized in that it is arranged in such a way that the pressure in the interior volume (9, 9.2) of the dosimeter body is greater than the sum of the pressure in the injection chamber (S) and of the loss of hydraulic head in the connection between the second chamber (12) and the injection chamber (S).

3. The dosimeter as claimed in claim 2, characterized in that a restriction member (32) is provided downstream of the outlet (3) of the dosimeter and upstream of the injection chamber (S) in order to create a head loss.

4. The dosimeter as claimed in claim 2, characterized in that the second chamber (12) is equipped with an intake valve (20) and with a delivery valve (23).

5. The dosimeter as claimed in claim 2, characterized in that the interior volume (9.2) of the dosimeter body communicates directly with the inlet (2.2) of the dosimeter so that the head loss of the motor between the interior volume (9.2) of the dosimeter body and the outlet (3.2) contributes to pushing the membrane back.

6. The dosimeter as claimed in claim 1, characterized in that a restriction member (32) is provided downstream of the outlet (3) of the dosimeter and upstream of the injection chamber (S) in order to create a head loss.

7. The dosimeter as claimed in claim 6, characterized in that the second chamber (12) is equipped with an intake valve (20) and with a delivery valve (23).

8. The dosimeter as claimed in claim 6, characterized in that the interior volume (9.2) of the dosimeter body communicates directly with the inlet (2.2) of the dosimeter so that the head loss of the motor between the interior volume (9.2) of the dosimeter body and the outlet (3.2) contributes to pushing the membrane back.

9. The dosimeter as claimed in claim 1, characterized in that the second chamber (12) is equipped with an intake valve (20) and with a delivery valve (23).

10. The dosimeter as claimed in claim 1, characterized in that the membrane (M), on the opposite side to the second chamber (12), bounds a space (E) communicating with the first end (7) of the first chamber (6).

11. The dosimeter as claimed in claim 1, characterized in that the second chamber (12) is situated in a volume bounded by opposing concavities of a first cup (13) and of a second cup (14) which are assembled, the periphery of the membrane (M) being clamped in a fluidtight manner between the two assembled cups, the first cup (13) being fixed to the dosimeter body (1) around the first end (7) of the first chamber, while the second cup is equipped with the intake orifice (20) and with the delivery orifice (23).

12. The dosimeter as claimed in claim 11, characterized in that the central part of the membrane (M) is secured to a rigid disk (16) itself secured to an axial rod (17) facing away from the second chamber (12) and able to slide in a guide bore (18) of the dosimeter body, while leaving a passage for the liquid.

13. The dosimeter as claimed in claim 1, characterized in that the axial position of a sleeve (6*a*) delimiting the cylindrical first chamber (6) in which the plunger piston moves can be adjusted using a rotary ring.

14. The dosimeter as claimed in claim 1, characterized in that the restriction member (32) situated downstream of the outlet (3) of the dosimeter body consists of a plug fitted with a cylindrical skirt (33) with at least one slot (34), installed on an inlet orifice of a union (28) connected to the outlet of the dosimeter body.

15. The dosimeter as claimed in claim 1, characterized in that the valve provided to allow the liquid to pass to the interior volume (9) of the body, during the return stroke, once the pressure in the first chamber (6) has exceeded a certain pressure, is a preloaded valve (35) installed in a chamber (36) provided at the end of the plunger (5.1).

16. The dosimeter as claimed in claim 1, characterized in that the interior volume (9.2) of the dosimeter body communicates directly with the inlet (2.2) of the dosimeter so that the head loss of the motor between the interior volume (9.2) of the dosimeter body and the outlet (3.2) contributes to pushing the membrane back.

* * * * *